US008583008B2

(12) United States Patent
Pitas et al.

(10) Patent No.: US 8,583,008 B2
(45) Date of Patent: Nov. 12, 2013

(54) APPARATUS FOR PREVENTING DAMAGE TO A PHOTOCONDUCTOR

(75) Inventors: Jeffrey A. Pitas, Macedon, NY (US); Richard G. Luther, Hamlin, NY (US); Matthias H. Regelsberger, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 212 days.

(21) Appl. No.: 12/908,168

(22) Filed: Oct. 20, 2010

(65) Prior Publication Data

US 2012/0099895 A1 Apr. 26, 2012

(51) Int. Cl.
*G03G 21/18* (2006.01)

(52) U.S. Cl.
USPC ..... 399/114

(58) Field of Classification Search
USPC ..... 399/114, 116
See application file for complete search history.

(56) References Cited

U.S. PATENT DOCUMENTS 5,231,453 A * 7/1993 Nakai et al. ..... 399/114
7,184,689 B2 * 2/2007 Kang et al. ..... 399/114
2005/0238386 A1 * 10/2005 Baek ..... 399/114

FOREIGN PATENT DOCUMENTS

JP 08110744 A * 4/1996

OTHER PUBLICATIONS

Machine translation of JP08110744.*

* cited by examiner

*Primary Examiner* — Walter L Lindsay, Jr.
*Assistant Examiner* — Barnabas Fekete
(74) *Attorney, Agent, or Firm* — Nelson Adrian Blish

(57) ABSTRACT

A system for in situ replacement of a cartridge for an electrophotographic printer includes a photoreceptive member in the cartridge; a retractable shield enclosing the photoreceptive member; and a retraction mechanism in the cartridge for retracting the retractable shield when the cartridge is inserted into the printer.

13 Claims, 3 Drawing Sheets

APPARATUS FOR PREVENTING DAMAGE TO A PHOTOCONDUCTOR

CROSS REFERENCE TO RELATED APPLICATIONS

Reference is made to commonly-assigned U.S. patent application Ser. No. 12/908,158 (now U.S. Publication No. 2012/0099894), filed Oct. 20, 2010, entitled METHOD FOR PREVENTING DAMAGE TO A PHOTOCONDUCTOR, by Pitas et al.; U.S. patent application Ser. No. 12/849,044 (now U.S. Publication No. 2012/0033992), filed Aug. 3, 2010, entitled METHOD FOR PREVENTING DAMAGE TO A PHOTOCONDUCTOR, by Pitas et al.; and U.S. patent application Ser. No. 12/849,041 (now U.S. Publication No. 2012/0033991), filed Aug. 3, 2010, entitled PREVENTING DAMAGE TO A PHOTOCONDUCTOR, by Pitas et al.; the disclosures of which are incorporated herein.

FIELD OF THE INVENTION

This invention relates to electrophotography in general and in particular to a replacement cartridge for an electrophotographic printer.

BACKGROUND OF THE INVENTION

Electrophotographic equipment utilizes sensitive components that must be routinely serviced by either dedicated service personnel or by the end user. Many of these components are easily damaged unless care is exercised during replacement. In some instances, it is considered imprudent to depend upon an individual exercising care as a step in carrying out this critical operation. This is especially important when the risk of error is high, and the cost and machine down-time associated with error is great.

A primary component requiring frequent replacement within an electrophotographic print engine is the photoreceptive member. The function of the photoreceptor is to provide a means of developing an image and transferring that image to paper. The photoreceptor is coated with photosensitive material which is essential to operation of electrographic printers. The photosensitive material is easily scratched and can be damaged by exposure to ambient light if handled imprudently. This type of damage creates unacceptable image quality defects in the transferred image.

In close proximity to the photoreceptive member are many components that support the imaging of the photoreceptor. These components can scratch or abrade the photoreceptive member during replacement. There is a need to eliminate the potential for damage to the photoreceptive member.

SUMMARY OF THE INVENTION

Briefly, according to one aspect of the present invention a system for in situ replacement of a cartridge for an electrophotographic printer includes a photoreceptive member in the cartridge; a retractable shield enclosing the photoreceptive member; and a refraction mechanism in the cartridge for retracting the retractable shield when the cartridge is inserted into the printer.

The invention and its objects and advantages will become more apparent in the detailed description of the preferred embodiment presented below.

DETAILED DESCRIPTION OF THE INVENTION

The present invention will be directed in particular to elements forming part of, or in cooperation more directly with the apparatus in accordance with the present invention. It is to be understood that elements not specifically shown or described may take various forms well known to those skilled in the art.

An electrophotographic printer includes all components necessary to accomplish the task of printing an image on paper. A printer is comprised of various sub-assemblies which perform specific functions.

Figure 1:
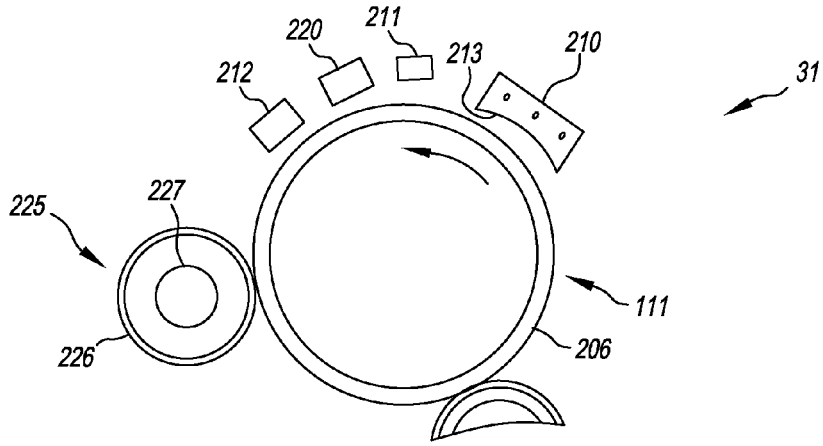
FIG. 1 is a cross-section of a replacement cartridge according to the present invention.

An imaging module in the printer consists of components to enable printing of a single color image. Multiple modules may be assembled to enable the printing of multiple color images. FIG. 1 shows details of a typical printing module 31, which may be assembled with other imaging modules to enable printing multiple colors.

Primary charging subsystem 210 uniformly electrostatically charges photoreceptor 206 of photoreceptive member 111, shown in the form of an imaging cylinder. Charging subsystem 210 may include a grid 213 having a selected voltage, or may be in the form of a roller with conductive properties.

Additional necessary components provided for control may be assembled around the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206.

Image writer 220 is used to expose photoreceptor 206 and may be a light emitting diode (LED) array or other similar mechanisms or laser. Toning unit 225, comprising elements 226 and 227 is used to develop the latent image created by writer 220 on photoreceptor 206. Cleaning unit 230 removes residual toner from photoreceptor 206 after transfer of the image to a secondary receiver. Other meters and components may be included.

Figure 2:
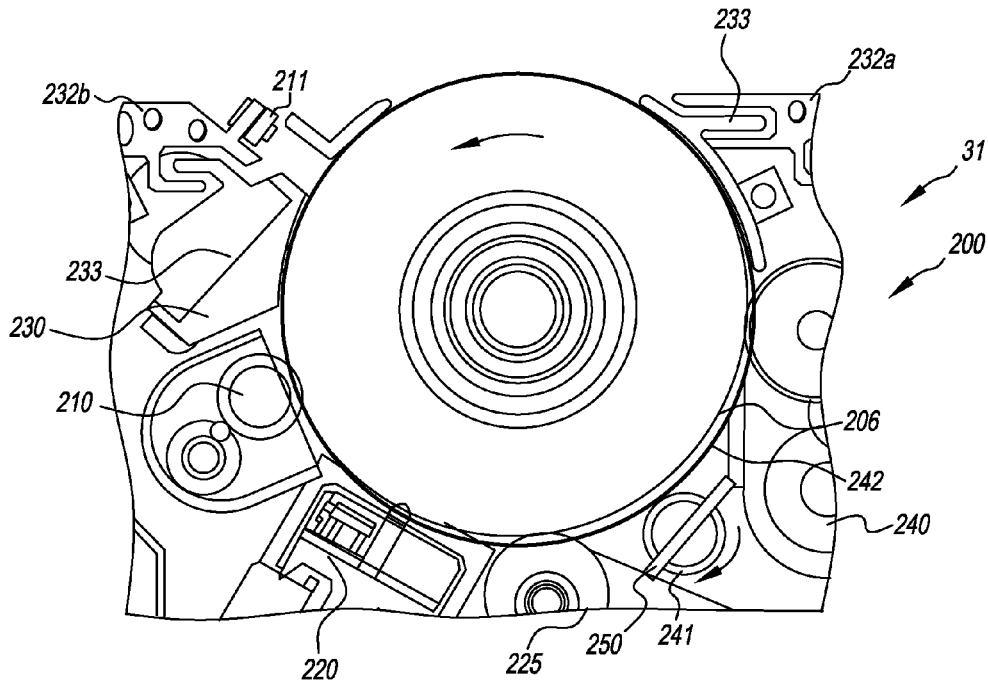
FIG. 2 is a cross-section of a replacement cartridge in an electrophotographic printer with a protective mechanism.

Within the imaging module 31, periodic replacement of critical components is necessary to ensure proper function. It may be desired to cluster multiple components to enable simultaneous replacement. Referring to FIG. 2, shown here with a change in form for this invention, a replacement cartridge 200 within imaging module 31 is created consisting of a photoreceptive member 111, cleaning unit 230, and charging subsystem 210. The photoreceptor 206 may be rigid, or non-rigid, organic or non-organic and the form of the photoreceptive member 111, although shown here in a circular format may be a photoreceptor belt path of any closed shape. These components are assembled into a cartridge and held in place with a plastic housing 233. Further, a windup shield 240 is applied to the module, which serves to prevent damage to the photoreceptor 206. The replacement cartridge slides into the electrophotographic printer using guides 232*a* and 232*b*. Guides 232*a* and 232*b* are attached to the printer and help mount and align the replacement cartridge in the proper position.

Because of the proximity of subsystems that interface with module 31 and with replacement cartridge 200, it is necessary to have large areas of the photoreceptive member 111 open during use. During insertion into the print engine, these open, unprotected areas can be damaged either mechanically or by light exposure. Therefore it is necessary to protect the photoreceptive member 111 from damage, either from extraneous light, fingerprints or mechanical scrapes. Many designs use paper as a protection means which is removed prior to insertion into the machine. From the time that paper is removed from a photoreceptive member 111, and it is inserted into the machine, it is prone to damage. The windup shield 240 is attached to the replacement cartridge housing 233, and protects from damage, the photoreceptor 206 during the installation process. The windup shield 240 stays in place when the replacement cartridge 200 is installed in the printer. Alternately, if desired the windup shield may be removed and discarded, as dictated by the particular design.

The windup shield consists of housing 241 and shield 242. The shield may be clear, translucent or opaque as dictated by the light sensitivity of components being protected. The shield may or may not rest on the entire surface of the photoreceptor 206. When the cartridge is slid into position the shield 242 is retracted into housing 241 through rotary motion. The windup can be either by turning a manual crank 250 by the installer, or an alternate construction has a torsion spring arrangement and plunger, such that when the plunger is depressed, when the replacement cartridge 200 is installed, a preloaded torsion spring winds the shield 242 into the housing 241.

Active drive means may be incorporated. A particular advantage in the arrangement shown is that the action of the windup shield is in the same direction as the motion of the photoreceptive member 111. The cleaner unit 230 and charger subsystem 210, therefore have a similar interface during windup as to the photoreceptive member 111 during use. By winding the shield in a similar direction, the windup action may be delayed until the machine is started, with the photoreceptive member acting to help wind up the shield. Winding the shield 242 at the same speed as the photoreceptive member 111 eliminates relative motion between the shield and photoreceptor 206 which reduces scuffing the surface. Also, the photoreceptive member 111 may have a one way clutch incorporated such that the windup causes the photoreceptive member to turn.

Figure 3:
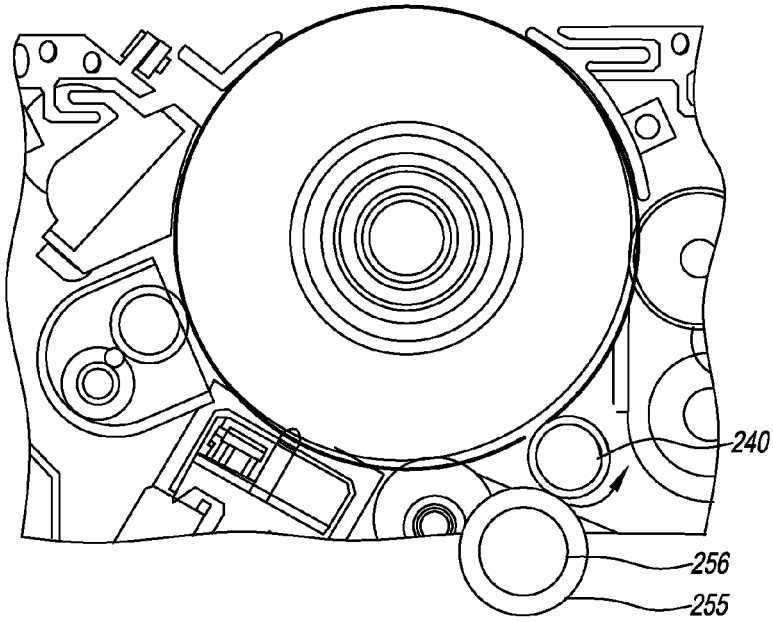
FIG. 3 is a cross-section of a replacement cartridge in an electrophotographic printer with a protective mechanism.

FIG. 3 shows an alternate arrangement, whereas the direction of motion of the rotary shield has been reversed. It may be preferable to reverse the direction of rotation of the windup shield, as determined by the details of a particular design. Also shown is drive 255 and gear 256. This design as in the previous embodiment may be driven by manual crank 250, a preloaded torsion spring a drive 255 and gear 256 or by other drive means.

Figure 4:
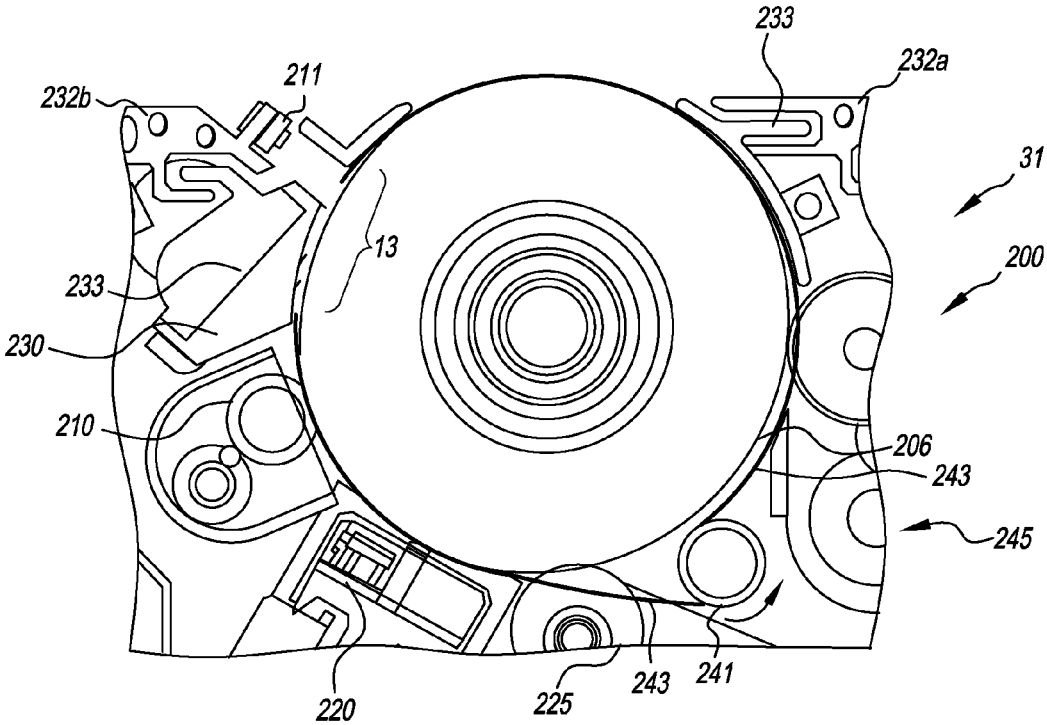
FIG. 4 is a cross-section of a replacement cartridge in an electrophotographic printer with a protective mechanism.

FIG. 4 shows that the windup shield 240 shown in FIG. 2 has been replaced with a dual windup shield 245. The dual windup shield 245 consists of dual shield 243 and housing 241. The dual shield 243 arrangement has the advantage of allowing certain elements used in the cartridge to remain in contact with the photoreceptor 206 when installed in the replacement cartridge 200, if required by the particular design, by providing a gap 13 in the shield 243. Drive means may be, either by manual crank 250, torsion spring, drive 255 and gear 256 or by other drive means. For the dual shield arrangement, the rotation direction may be either clockwise or counterclockwise as dictated by the particular design.

Figure 5:
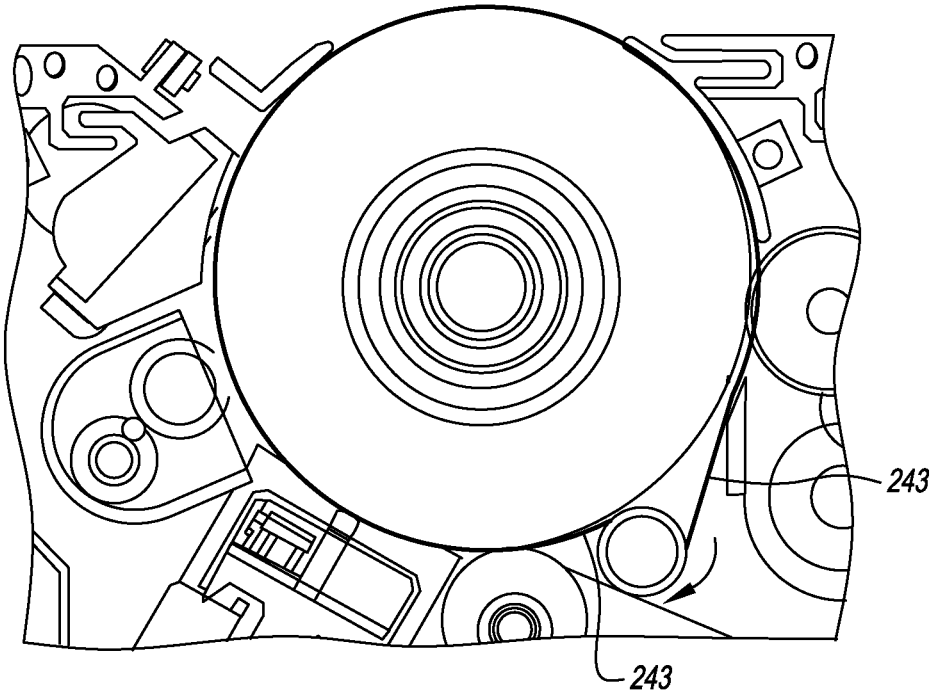
FIG. 5 is a cross-section of a replacement cartridge in an electrophotographic printer with a protective mechanism.

Referring now to FIG. 5, the dual shield 243 of FIG. 4 has overlapping portions providing additional damage protection. Also shown is a rotation of the shield in the opposite direction to the device of FIG. 4.

The invention has been described in detail with particular reference to certain preferred embodiments thereof, but it will be understood that variations and modifications can be effected within the scope of the invention.

PARTS LIST

13 gap
31 print module
111 photoreceptive member
200 replacement cartridge
206 photoreceptor
210 charging subsystem
211 meter
212 meter
213 grid
220 image writer
225 toning unit
226 element
227 element
230 cleaning unit
232*a* guide
232*b* guide
233 plastic housing
240 windup shield
241 housing
242 shield
243 dual shield
245 dual windup shield
250 crank
255 drive
256 gear

The invention claimed is:

1. A system for replacement of a cartridge for an electrophotographic printer comprising:
- a photoreceptive member in said cartridge;
- a retractable shield consisting of two separate pieces enclosing the photoreceptive member;
- a retraction mechanism in said cartridge for retracting the retractable shield when the cartridge is inserted into the printer; and
- wherein retraction of a first piece of the shield is assisted by rotation of the photoreceptive member.

2. The system as in claim 1 wherein the photoreceptive member is cylindrical.

3. The system as in claim 1 wherein the photoreceptive member is rigid.

4. The system as in claim 1 further wherein a first piece of the shield is retracted in a direction of rotation of the photoreceptive member.

5. The system as in claim 1 wherein the shield is retraced by a spring loaded mechanism, a motor, or manually.

6. The system as in claim 1 wherein there is a gap in the shield between a first piece of the shield and a second piece of the shield.

7. The system as in claim 1 wherein both pieces of the shield are wound on a common roller.

8. The system as in claim 1 wherein the retractable shield rests on a surface of the photoreceptive member.

9. The system as in claim 1 wherein the retractable shield is opaque.

10. The system as in claim 1 wherein the cartridge comprises a component selected from a group consisting of a charging element, cleaning mechanism, writing mechanism, or toning mechanism.

11. The system as in claim 1 wherein the photoreceptive member is an organic photoreceptive member.

12. The system as in claim 6 wherein the gap allows for a cartridge element to remain in contact with the photoreceptor during installation.

13. A system for replacement of a cartridge for an electrophotographic printer comprising:

a photoreceptive member in said cartridge;

a retractable shield consisting of two separate pieces enclosing the photoreceptive member;

a retraction mechanism in said cartridge for retracting the retractable shield when the cartridge is inserted into the printer;

wherein a first piece of the shield is retracted in a direction of rotation opposite that of the photoreceptive member wherein the photoreceptive member freewheels during retraction of the shield.

* * * * *